US005331789A

United States Patent [19]

Cur et al.

[11] Patent Number: 5,331,789

[45] Date of Patent: Jul. 26, 1994

[54] VACUUM PROCESSING MACHINE AND METHOD

[75] Inventors: Nihat O. Cur, Royalton Township, Berrien County; Richard W. Kruck, Sodus Township, Berrien County, both of Mich.

[73] Assignee: Whirlpool Corporation, Benton Harbor, Mich.

[21] Appl. No.: 35,826

[22] Filed: Mar. 23, 1993

[51] Int. Cl.[5] ..... B32B 17/02; B65B 31/02; B65B 1/24

[52] U.S. Cl. ..... 53/434; 53/170; 53/449; 53/512; 53/527

[58] Field of Search ..... 53/434, 433, 432, 512, 53/511, 510, 527, 526, 449, 170, 79, 408, 405, 403, 400; 428/69, 68, 76; 220/422, 420

[56] References Cited

U.S. PATENT DOCUMENTS

| | | | |
|---|---|---|---|
| 3,027,753 | 4/1962 | Harder, Jr. | 73/40.7 |
| 3,477,562 | 11/1969 | Allen et al. | 53/527 X |
| 3,716,081 | 2/1973 | Landreville | 53/527 X |
| 4,004,398 | 1/1977 | Larsson et al. | 53/527 X |
| 4,636,415 | 1/1987 | Barito et al. | 428/68 |
| 4,662,521 | 5/1987 | Moretti | 206/484.2 |
| 4,681,788 | 7/1987 | Barito et al. | 53/434 X |
| 4,683,702 | 8/1987 | Vis | 53/433 |
| 5,076,984 | 12/1991 | Bisplinghoff et al. | 264/102 |

*Primary Examiner*—James F. Coan
*Attorney, Agent, or Firm*—Stephen D. Krefman; Thomas J. Roth; Thomas E. Turcotte

[57] ABSTRACT

A vacuum processing machine and method are provided for use in assembling a vacuum insulation panel from a gas impermeable bag and a gas porous pouch filled with a microporous powder. The machine has a housing which is sealable in an air tight manner. A pair of substantially parallel plates are positioned within said housing. The housing is openable to receive the bag between the facing front sides of the plates. A vacuum source communicates with an interior of said housing to evacuate gases from said bag and pouch. Heat sealing apparatus are positioned within the housing for sealing an edge of said bag after evacuation of said gases from said bag and pouch. A nozzle for injecting a trace amount of helium at a pressure preferably below 1 mm Hg into the bag after evacuation of the gases and before sealing of the bag may be provided if desired.

15 Claims, 8 Drawing Sheets

VACUUM PROCESSING MACHINE AND METHOD

BACKGROUND OF THE INVENTION

The present invention relates to a vacuum processing machine and method for forming a vacuum insulation panel from a gas impermeable bag and a gas porous pouch filled with a microporous powder.

Vacuum insulation panels are useful in a variety of environments, and in particular in conjunction with refrigeration apparatus in which they are utilized as insulating panels in the walls of refrigerators and freezers.

Typically a vacuum insulation panel has some type of insulating material, generally powders or microporous sheets of insulating material which are placed into a non-porous bag and, after evacuation of all gases, the bag is sealed. Such panels and a method for fabricating them are disclosed in U.S. Pat. No. 5,018,328, assigned to Whirlpool Corporation, the assignee of the present application, the disclosure of said patent being incorporated herein by reference, as well as in U.S. Pat. Nos. 5,076,984 and 4,683,702.

The use of a gas permeable enclosure to contain the powder during evacuation is disclosed in the '984 and '702 patents listed above. The use of multiple compartments in an insulation panel is disclosed in the '328 patent.

SUMMARY OF THE INVENTION

The present invention provides a method for assembling vacuum panels in a vacuum processing machine utilizing a significantly improved process over other presently known processes.

In an embodiment of the invention set forth herein, a vacuum processing machine is disclosed which has a housing sealable in an air tight manner. A pair of substantially parallel plates are positioned within the housing. The housing is openable to receive a gas impermeable bag between the facing front sides of the plates. Porous pouches filled with microporous insulating powder are also to be inserted within the bag. After the housing is sealed closed, a vacuum is applied to the interior of the housing to evacuate gases from the bag and the pouch. A heat sealing apparatus is positioned within the housing for sealing an open edge of the bag after evacuation of the gases from the bag and the pouch. An optional arrangement allows for a nozzle to be positioned within the housing for injecting a very small trace amount of helium (preferably under 1 mm Hg pressure) into the bag after evacuation of the gases and before sealing of the bag. This allows for leak testing of the completed insulation panel.

DETAILED DESCRIPTION OF THE PREFERRED EMBODIMENTS

Figure 1:
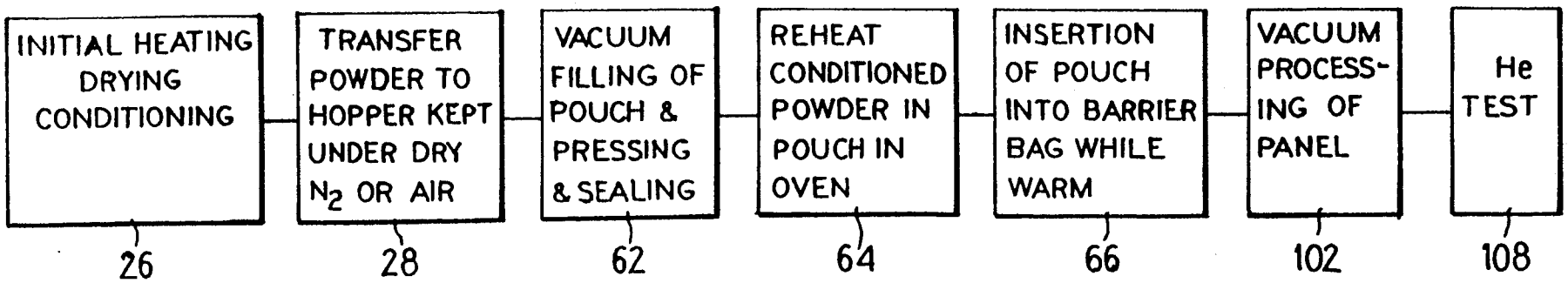
FIG. 1 is a flow chart schematically illustrating an embodiment of the method of the present invention.
Figure 4:
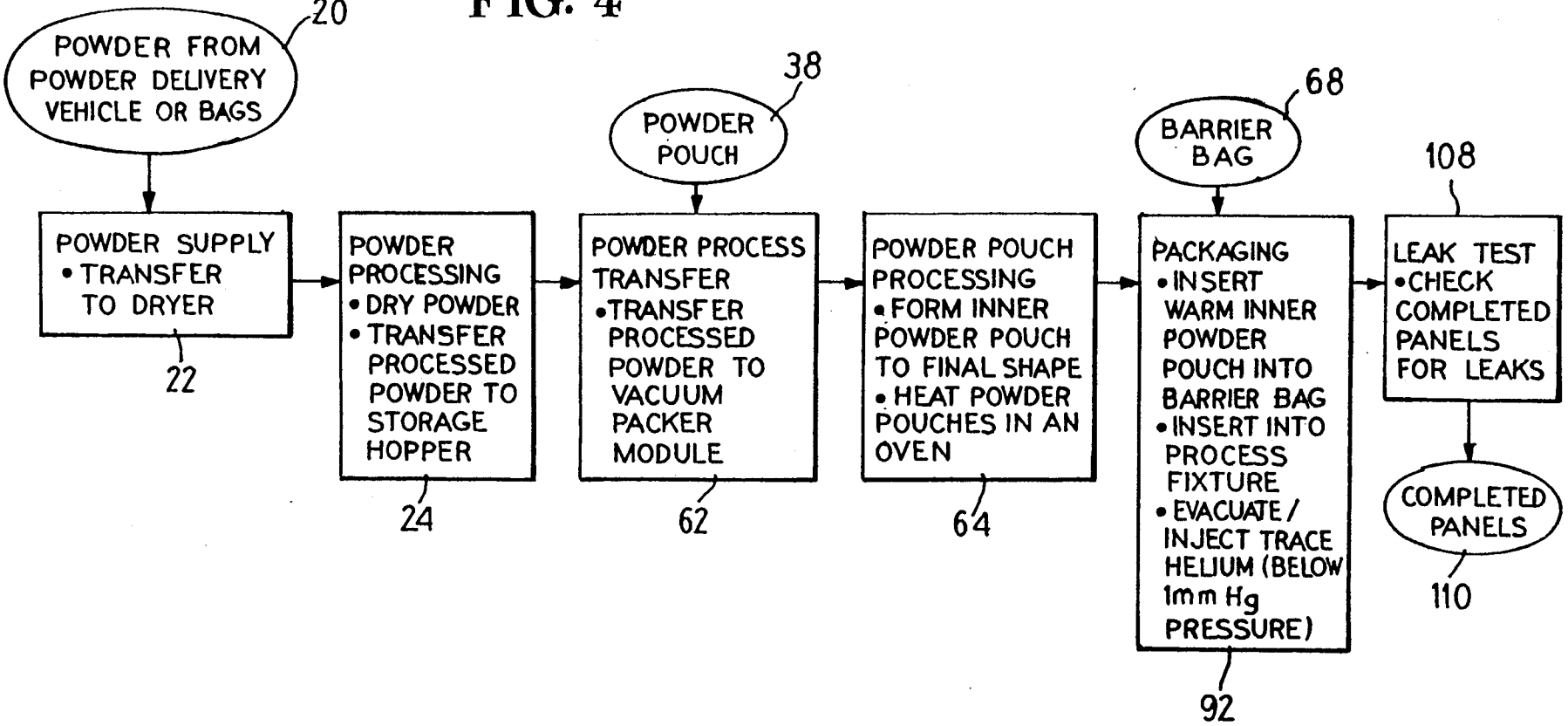
FIG. 4 is a flow chart illustrating steps utilized in the method of the present invention.

In FIGS. 1 and 4 there is illustrated a first embodiment of a method for assembling a vacuum insulation panel. In this panel, a microporous powder is used as the insulating material. Step 20 (FIG. 4) shows a step of delivery of the powder from a delivery vehicle or powder bags. The powder is delivered to a powder supply device, such as a storage hopper in step 22 or directly from bags to the drier in step 24 by using an automatic bag splitter. The powder is then dried in step 24 (FIG. 4), step 26 (FIG. 1) such as by heating and/or subjecting it to a vacuum in order to remove moisture from the powder. The heating of the powder at this stage, to remove moisture, can occur at temperatures up to 400° F. (205° C.) or higher if desired. The dry powder is then transferred to a storage hopper 60 (FIGS. 6 and 7) in step 28 (FIG. 1) where it may be maintained in a dry condition such as by storing it under a dry nitrogen (or air) blanket (to prevent reabsorption of moisture into the powder).

Figure 3A:
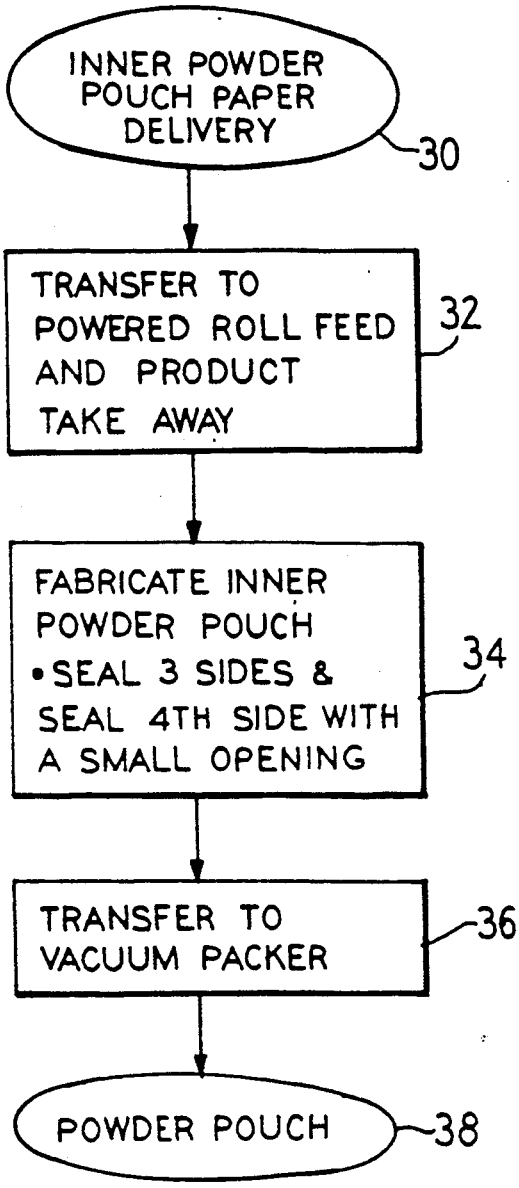
FIG. 3*a* is a flow chart schematically illustrating fabrication of the powder pouch.

The powder is then loaded into a powder pouch which has been fabricated in accordance with the steps illustrated in FIG. 3*a*. In step 30 the pouch material is delivered and in step 32 it is transferred to a powered roll feed mechanism. Step 34 illustrates fabrication of the pouch in which three sides of the pouch are sealed. Also, preferably, part of the fourth side is also sealed leaving only a small opening into the interior of the pouch. In a preferred embodiment the inner porous pouches are produced using a hot head form seal with a special fixture, leaving the small opening for the loading of the microporous powder into the pouch.

To prevent material sticking and to enable machine indexing with hot head heat sealing, a unique process technique had to be devised. The two layers of inner porous pouch films are fed into the heat sealing machine sandwiched in between two teflon cloth layers. The pouch films in between the teflon layers get melted and fused together and get trimmed without sticking to the teflon cloths.

Figure 6:
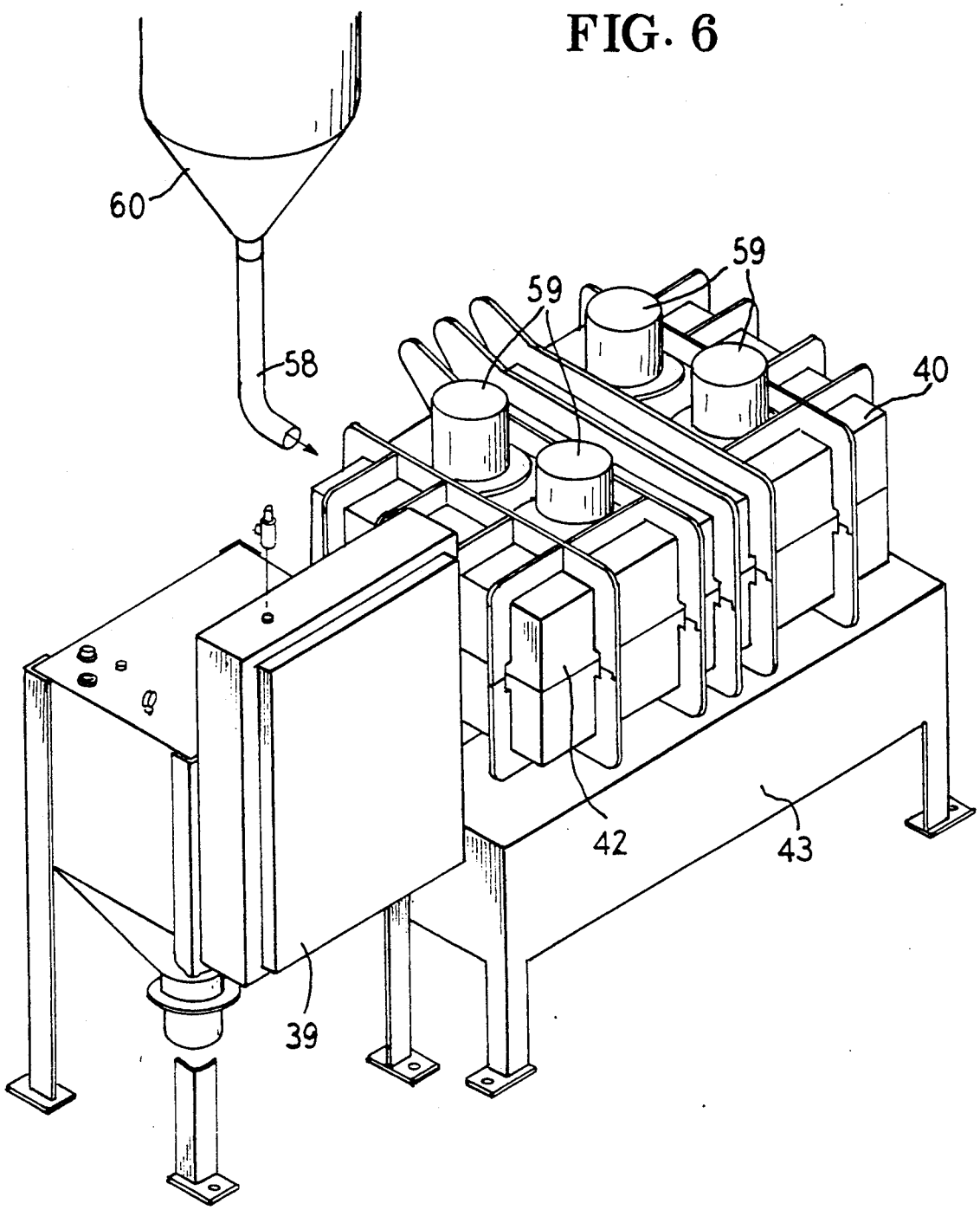
FIG. 6 is a schematic view of a vacuum filling machine used to fill the microporous pouch with insulation material and subsequently press it.

In step 36 the fabricated pouch is transferred from the pouch fabricating area as a nearly completed pouch as indicated in step 38 (FIGS. 3*a* and 4). The powder pouch is placed within a vacuum filling machine (VFM) 40 (FIG. 6). The VFM 40 consists of an exterior housing 42 which can be sealed in an air tight manner. Shown also in FIG. 6, the VFM 40 has a screw jack type 59 press system, a platform 43 with a sensitive weight scale and a microprocessor based PLC (programmable logic controlled) control system 39.

Figure 7:
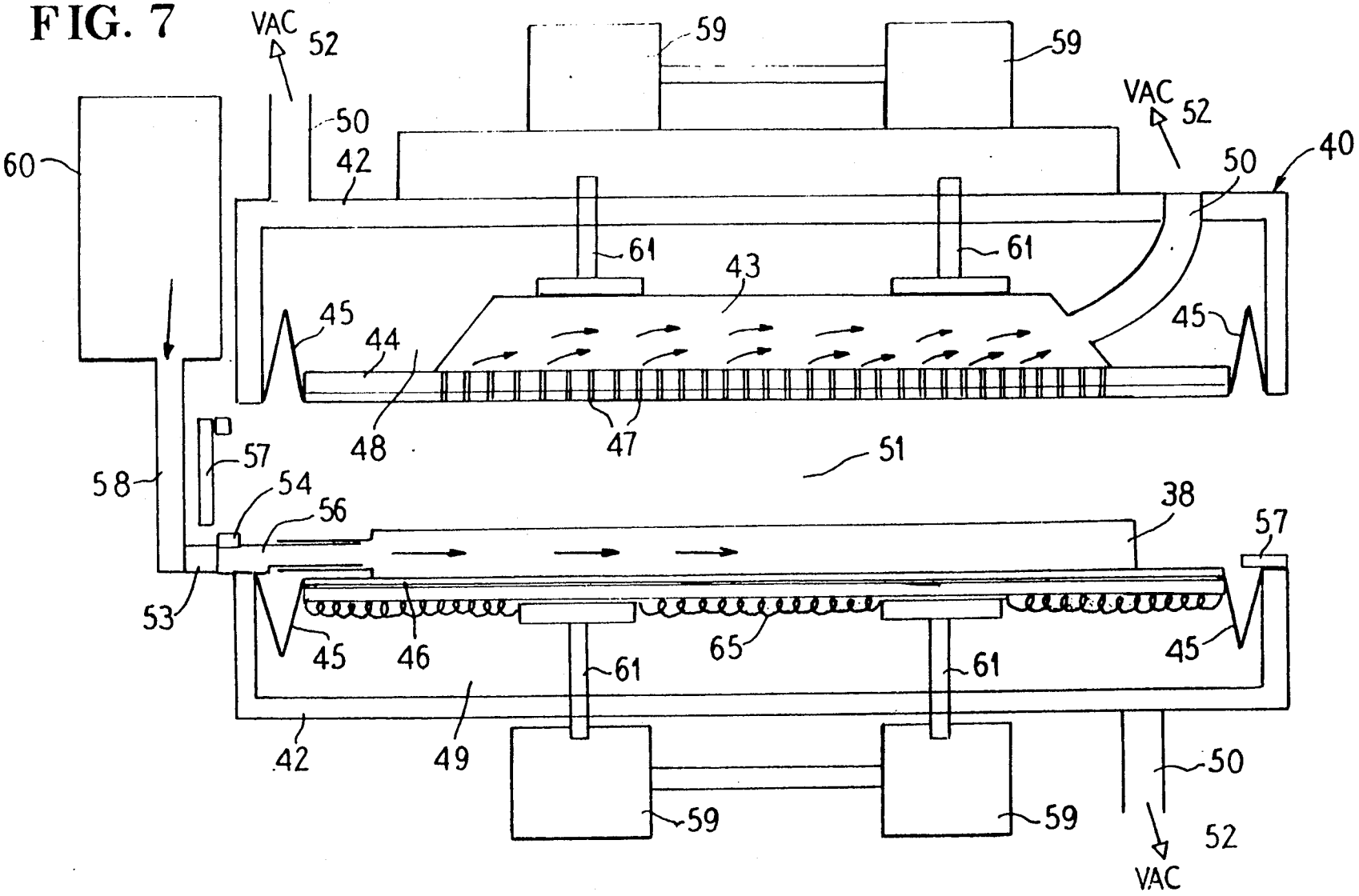
FIG. 7 is a side sectional view of the vacuum filling machine used to fill the microporous pouch with insulation material and subsequently press it.

Within the housing (as illustrated in FIG. 7) there are a perforated plate 44 (upper) and, parallel to it, a solid plate 46 (lower) between which the powder pouch 38 is placed. A vacuum hood 43 is situated above the perforated plate 44 and covers most of the surface of the plate 44. Perforations 47 extend from a front side 44*a* to a back side 44*b* of the plate 44 covering the total area underneath the vacuum hood 43. The plates 44, 46 are spaced from the housing 42 by an upper chamber 48 (facing the back side 44*b* and the vacuum hood 43) and by a lower chamber 49 (facing the back side 46*b*). Both the upper chamber 48 and the lower chamber 49 are sealed by flexible rubber seals 45 extending from the plates 44, 46 to the housing 42.

The chambers 48, 49 can be evacuated through a conduit 50 leading to a vacuum source 52. A space 51 in between the movable plates 44, 46 where the pouch 38 is located (when the upper and lower sections of the housing 42 closes) can be also evacuated through the perforations 47 via the vacuum hood 43. The vacuum hood is also evacuated through the conduit 50 leading to the same vacuum source 52. An opening 54 is provided through the housing 42 for insertion of a nozzle 56 connected to a conduit 58 (via a valve 53) leading from the storage hopper 60. The nozzle 56 extends into the opening in the pouch 38. Upon the actuation of the vacuum 52, the powder will be drawn from the hopper 60 into the interior of the pouch 38 to completely fill the pouch due to suction created in the space 51 by the vacuum hood 43 through the perforations 47. Since the chambers 48, 49 are exposed to the same vacuum source 52, the same suction pressure is created in the chambers 48, 49 and the space 51.

Once the pouch has been filled, the plates 44, 46 are moved towards one another by extension members 61 actuated by a screw-jack system 59 to compact and shape the pouch in a final form and a desired thickness and density by a pressing operation. The VFM 40 is capable of filling the powder into the porous pouches of varying thickness and sizes. The amount of powder being filled in the pouch 38 is measured by a sensitive weight scale situated on the platform 43 (FIG. 6) and regulated by a PLC controller. Once the pouch has been filled and pressed to its final form, the nozzle 56 is withdrawn from the pouch opening and the pouch opening is sealed by a heat sealer 57 (pressing can be done after heat sealing too). This step of filling the powder pouch is indicated at step 62 (FIGS. 1 and 4).

The VFM 40 can also optionally be provided with a heating element 65 on the back side of the solid plate 46, such as electric resistance elements, so that the pouch and its powder contents can be kept warmer than the standard room temperature (during filling and pressing) if the incoming powder from the hopper 60 is hot. The plate 46 can be heated to a temperature of 200°-300° F. (94°-150° C.) depending on the pouch material. Since it is relatively difficult and energy consuming to keep the conditioned powder hot in the hopper 60, the room temperature (but dried) powder is filled into the pouches in the preferred embodiment and the VFM 40 does not have the heating element 65. The post heating of the powder as indicated in step 64 is accomplished in an oven heated to a temperature of 200°-300° F. (94°-150° C.). The filled, formed and sealed powder pouches are kept in the oven for approximately 30 minutes before insertion into the barrier bags 68.

Figure 3B:
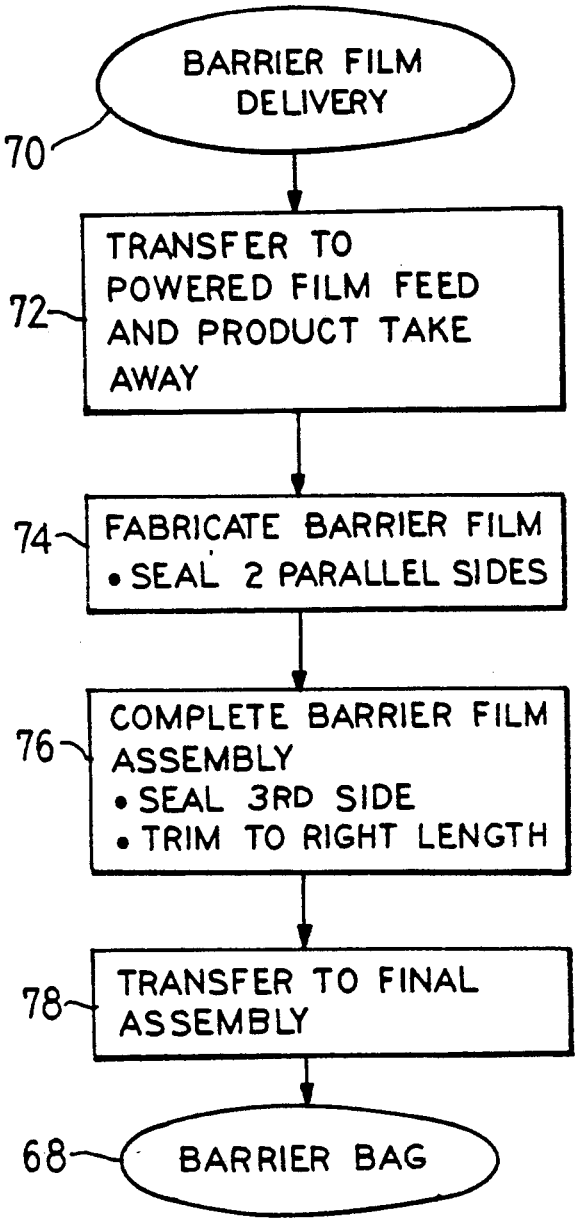
FIG. 3*b* is a flow chart schematically illustrating fabrication of the barrier bag.
Figure 8:
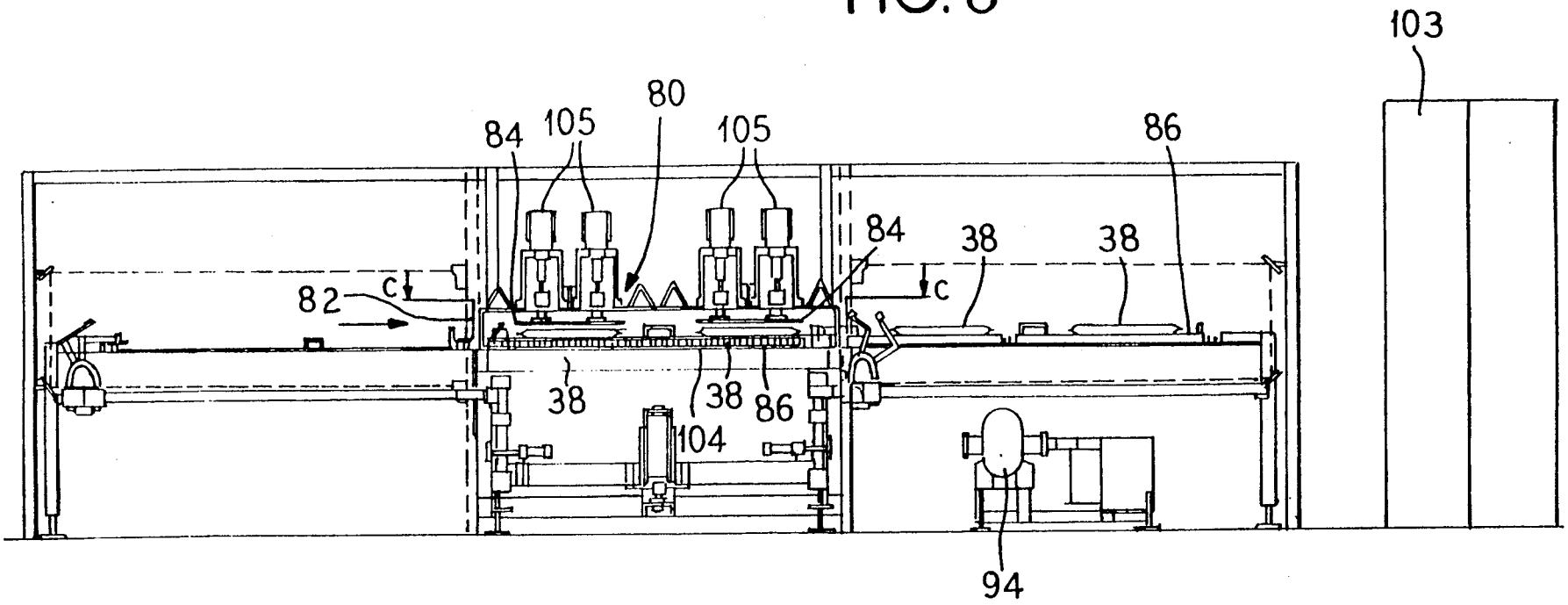
FIG. 8 is a front sectional view of the vacuum processing machine used to evacuate and seal the vacuum panel.
Figure 9:
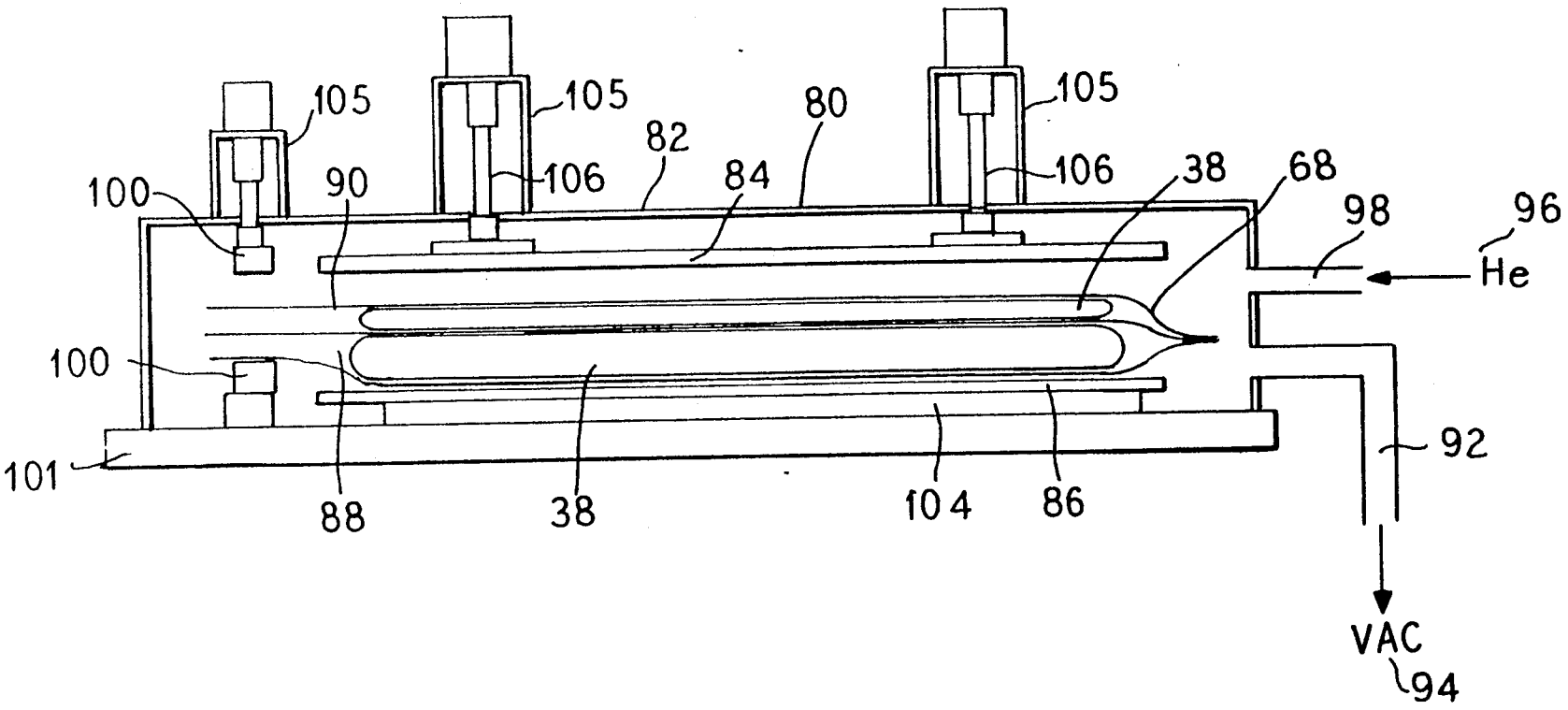
FIG. 9 is a side sectional schematic view of the vacuum processing device used to evacuate and seal the vacuum panel.

In the next step 66 (FIG. 1) the elevated temperature pouch 38 is inserted into a barrier bag which is formed in accordance with the steps illustrated in FIG. 3*b*. In step 70 the barrier film is delivered and in step 72 it is transferred to a powered film feed and product take away. In step 74 the film is partially fabricated by sealing two parallel sides of the film. Flat impulse heat sealers are preferably used to seal the film edges together. In step 76 a third side is sealed and the barrier bag is trimmed to the right length. The fourth side of the bag is left open in order to receive the powder pouch 38. In a preferred embodiment, the bag 68 consists of two compartments which are fabricated simultaneously by heat sealing three layers of plastic barrier films (two vacuum metalized plastic films and one aluminum foil plastic laminate film) at one time. In step 78 the barrier bag 68 is transferred to a vacuum processing machine (VPM) 80 (FIG. 8). The vacuum processing machine has an exterior housing 82 which can be sealed. Interior of the housing 82 are two parallel plates 84, 86, between which the barrier bag 68 is placed (FIG. 9). The barrier bag 68 illustrated in FIG. 9 has two separate internal compartments 88, 90. A powder pouch 38 is contained within each of the compartments 88, 90.

The insertion of the pouches into the panel as indicated in step 66 (FIG. 1) and step 92 (FIG. 4) occurs while the pouches 38 are still at an elevated temperature. The interior of the VPM housing 82 is connected by means of a conduit 92 to a source of vacuum 94 so that gases can be evacuated from the interior of the housing, including from within the barrier bag 68 and the powder pouches 38 (FIG. 9). Once evacuation of the interior of the housing 82 has occurred for a sufficient length of time to achieve the desired level of vacuum, preferably, a small, discrete amount of helium (at a low pressure, e.g. 1 mm Hg or less) is injected from a helium source 96 such as by flooding the interior of the housing by means of a conduit 98. The barrier bag is then sealed closed such as be engagement of heat sealing elements 100. This vacuum processing is indicated at step 102 (FIG. 1) and 92 (FIG. 4).

After the barrier bag 68 has been sealed, the vacuum panel will be in its final form. The plates 84, 86 are moved by extension devices 106 actuated by air cylinders 105 (sealed from the interior of the housing) to press against the completed vacuum panel at a force of approximately half an atmosphere to stabilize the shape of the vacuum panel prior to reintroduction of air into the interior of the VPM housing 82. Once the panel is held in place, the vacuum is released and air is permitted to re-enter the housing 82 permitting removal of the completed vacuum panels and transfer of those panels to an area for leak testing as indicated at step 108 (FIG. 1 and FIG. 4). The panels are moved in and out the interior of the housing 82 by movable process plates 86 situated over rollers 104 (FIG. 8). Following the leak test, the panels will be complete as indicated at step 110 (FIG. 4).

Figure 2:
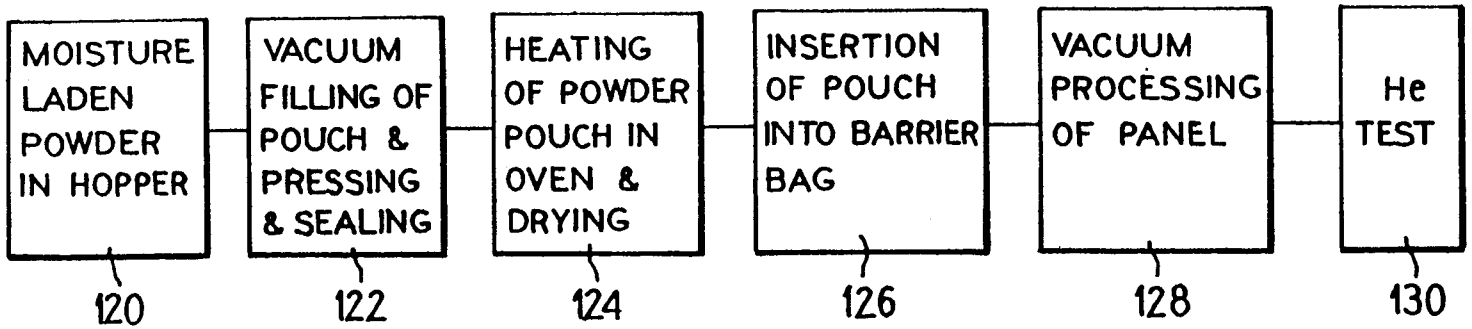
FIG. 2 is a flow chart schematically illustrating an embodiment of the present invention.

An alternate embodiment of the method is illustrated in FIG. 2. Step 120 indicates introduction of powder to a supply hopper in a step similar to steps 20 and 22 of FIG. 4. The process then jumps immediately to vacuum filling of the pouch 38 in step 122, identical to step 62 of FIGS. 1 and 4. Step 124 indicates heating of the filled pouch in an oven, preferably a vacuum oven in order to remove moisture from the insulating material. The warm and dry pouch is then immediately inserted into a barrier bag 68 in step 126, similarly to step 66 of FIG. 1. Vacuum processing of the bag 68 occurs in step 8 identical to step 102 of FIG. 1 and the panel then moves to helium testing in step 30 identical to step 108 of FIG. 1. Thus, in this embodiment the powder is heated only once, just prior to insertion into the bag and is inserted into the pouch in a moisture laden condition rather than a dry condition as would occur in the first embodiment.

In either embodiment the insulation powder in the pouch 38 is inserted into the barrier bag 68 in a dry and elevated temperature condition in order to reduce the time required for vacuum processing of the panel and to assure a high vacuum level within the resulting panel to be achieved in a relatively short period of time.

Figure 5:
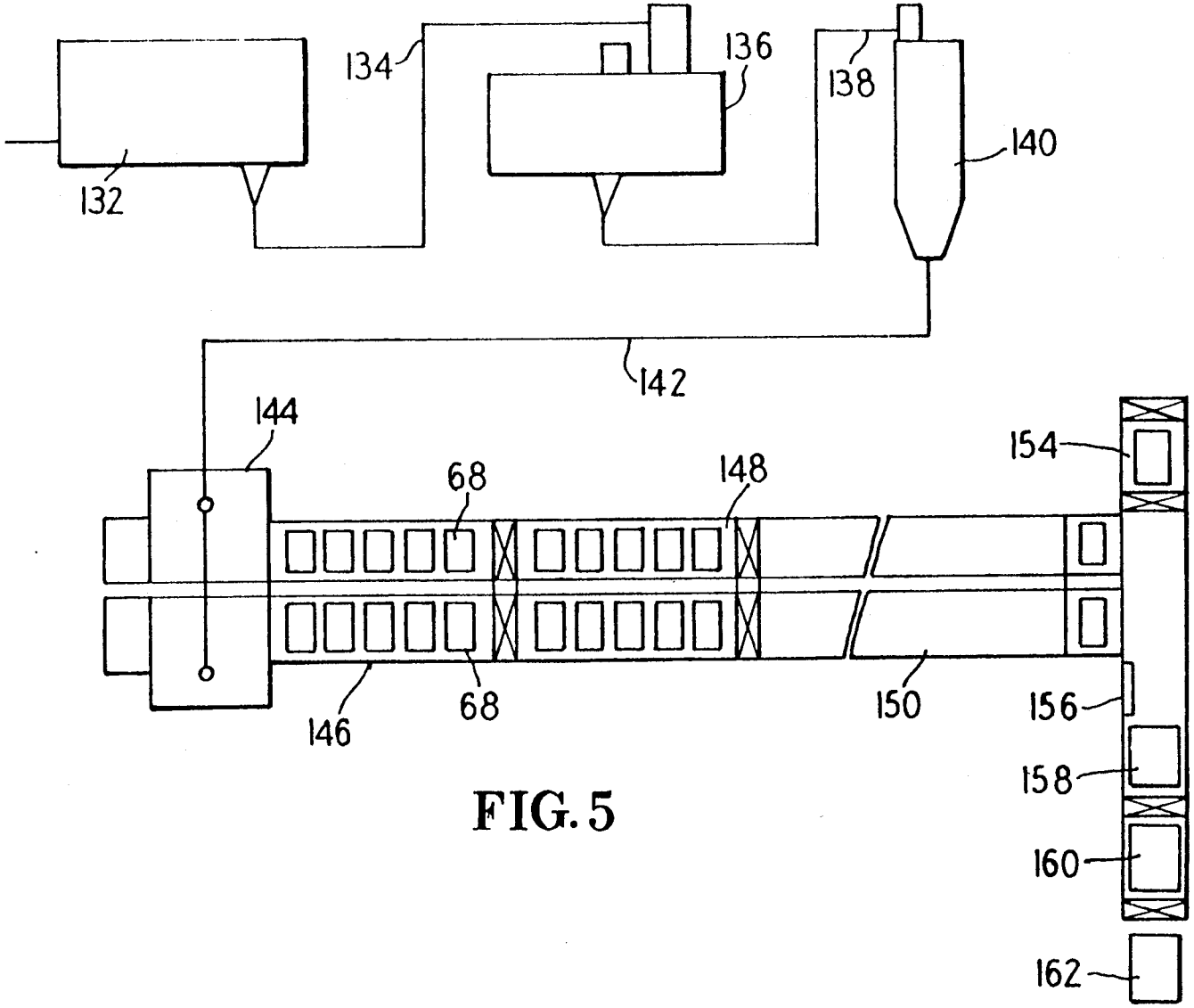
FIG. 5 illustrates an embodiment of a fabrication line utilizing the method of the present invention.

FIG. 5 illustrates a schematic equipment layout for an automated version of the process described in FIGS. 1 and 4. An automatic bag splitter 132 is used to open bags containing the insulating powder. It is also possible to bring the powder in large containers and store the powder in a storage silo. The powder is then transferred through a conduit 134 to a vacuum dryer 136 to initially dry the powder. The dried powder is then transferred through a conduit 138 to a storage hopper 140, which can be supplied with a dry nitrogen internal atmosphere. The powder is then supplied through conduit 142 to a vacuum filling machine 144. Filled pouches 38 are then carried along a conveyor to a preheating station 146 where the dry panels are raised to an elevated temperature. The pouches then move into an air lock 148 where groups of the pouches are subjected to a vacuum. The pouches, 38 then move into an evacuation chamber 150 where they remain under vacuum and at an elevated temperature while they are inserted into barrier bags 68 which have been introduced through a barrier bag air lock 154. The barrier bag is then sealed at station 156 and completed panels are accumulated at station 158 from which point they move to a leak test area 160 prior to being transferred to a completion area. 162.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A vacuum processing machine for use in assembling a vacuum insulation panel from a gas impermeable bag and a gas porous pouch filled with a microporous powder comprising:

a housing sealable in an air tight manner;

a pair of substantially parallel plates having facing front sides positioned within said housing;

said housing being openable to receive said bag between said facing front sides of said plates;

a vacuum source communicatable with an interior of said housing to evacuate gases from said bag and pouch; and heat sealing means positioned within said housing for sealing an edge of said bag after evacuation of said gases from said bag and pouch.

2. A vacuum processing machine according to claim 1, further including means for moving said plates toward one another to press against said bag after it has been evacuated and sealed.

3. A vacuum processing machine according to claim 1, further including means for injecting a trace amount of helium into said bag after it has been evacuated and before it has been sealed.

4. A vacuum processing machine according to claim 3, wherein said means for injecting helium comprise a nozzle positioned within said housing which communicates with a source of helium.

5. A vacuum processing machine according to claim 1, wherein said plates are oriented horizontally within said housing.

6. A vacuum processing machine for use in assembling a vacuum insulation panel from a gas impermeable bag and a gas porous pouch filled with a microporous powder comprising:

a housing sealable in an air tight manner;

a pair of substantially parallel support members with facing front sides positioned within an interior of said housing;

said housing being openable to receive said bag between said facing front sides of said members;

means for communicating a vacuum source with said interior of said housing; and heat sealing means positioned within said housing for sealing an edge of said bag after evacuation of gases from said bag and pouch.

7. A vacuum processing machine according to claim 6, wherein said support members comprise rigid plate members.

8. A vacuum processing machine according to claim 6, further including means for moving said plates toward one another to press against said bag after it has been evacuated and sealed.

9. A vacuum processing machine according to claim 6, further including means for injecting a trace amount of helium into said bag after it has been evacuated and before it has been sealed.

10. A vacuum processing machine according to claim 9, wherein said means for injection helium comprise a nozzle positioned within said housing which communicates with a source of helium.

11. A vacuum processing machine according to claim 6, wherein said support members are oriented horizontally within said housing.

12. A vacuum processing machine for use in assembling a vacuum insulation panel from a gas impermeable bag and a gas porous pouch filled with a microporous powder comprising:

a housing sealable in an air tight manner;

a pair of substantially parallel plates oriented horizontally within said housing;

said housing being openable to receive said bag between said facing front sides of said plates;

a vacuum source communicatable with an interior of said housing for evacuating gases from said bag and pouch;

heat sealing means positioned within said housing for sealing an edge of said bag after evacuation of said gases from said bag and pouch;

means for moving said plates toward one another to press against said bag after it has been evacuated and sealed; and means for injecting a trace amount of helium into said bag after it has been evacuated and before it has been sealed.

13. A method for assembling a vacuum insulation panel from a gas impermeable bag and a gas porous pouch filled with a microporous powder comprising:

placing a barrier bag within a housing sealable in an air tight manner; inserting a pouch filled with microporous powder insulation into said bag; sealing said housing;

forming a communication path between a vacuum source and an interior of said housing to evacuate gases from said bag and pouch; and sealing said bag after evacuation of said gases.

14. A method according to claim 13, including the step of introducing a trace amount of helium into said bag after it has been evacuated and before it has been sealed.

15. A method according to claim 13, wherein said sealing of said bag is accomplished by heat sealing.

* * * * *